US008176749B2

(12) United States Patent
LaMere et al.

(10) Patent No.: US 8,176,749 B2
(45) Date of Patent: May 15, 2012

(54) COOLER ADAPTED FOR USE IN MARINE ENVIRONMENT

(75) Inventors: Kenneth W. LaMere, Fernandina Beach, FL (US); Stephen M. Pescitelli, Buford, GA (US)

(73) Assignee: Kool Innovations, Inc., Fernandina Beach, FL (US)

( * ) Notice: Subject to any disclaimer, the term of this patent is extended or adjusted under 35 U.S.C. 154(b) by 517 days.

(21) Appl. No.: 12/488,511

(22) Filed: Jun. 19, 2009

(65) Prior Publication Data

US 2009/0314029 A1 Dec. 24, 2009

Related U.S. Application Data

(60) Provisional application No. 61/074,014, filed on Jun. 19, 2008.

(51) Int. Cl.
*F25D 3/08* (2006.01)

(52) U.S. Cl. ..... 62/457.5; 62/457.7

(58) Field of Classification Search ..... 62/457.7, 62/457.5, 457.1, 457.2, 459, 371; 220/810, 220/361, 315

See application file for complete search history.

(56) References Cited

U.S. PATENT DOCUMENTS

| | | | | | |
|---|---|---|---|---|---|
| 4,028,048 | A | * | 6/1977 | Woolworth | 432/5 |
| 4,577,475 | A | | 3/1986 | Herrera | |
| 4,648,512 | A | | 3/1987 | Tarozzi et al. | |
| 4,916,923 | A | * | 4/1990 | Adams et al. | 62/457.1 |
| 4,974,426 | A | * | 12/1990 | Gomez et al. | 62/457.7 |
| 5,257,509 | A | * | 11/1993 | Harris | 62/326 |
| 5,263,338 | A | * | 11/1993 | Banks | 62/331 |
| 5,353,607 | A | * | 10/1994 | McBride | 62/457.7 |
| 5,605,056 | A | * | 2/1997 | Brown et al. | 62/457.4 |
| 5,816,433 | A | | 10/1998 | Higgins | |
| 5,864,981 | A | | 2/1999 | Zeman | |
| 5,890,613 | A | | 4/1999 | Williams | |
| D433,285 | S | | 11/2000 | Camp, Jr. | |
| 6,149,005 | A | * | 11/2000 | Rusconi | 206/545 |
| 6,244,064 | B1 | | 6/2001 | Powell et al. | |
| 6,357,252 | B1 | | 3/2002 | Rand | |

(Continued)

FOREIGN PATENT DOCUMENTS

DE 4213071 A1 10/1998

(Continued)

*Primary Examiner* — Mohammad Ali
(74) *Attorney, Agent, or Firm* — Bryan W. Bockhop; Bockhop & Associates, LLC

(57) ABSTRACT

A cooler includes a box portion having a rigid outer shell and a rigid inner shell, an insulative material disposed between the outer shell and the inner shell. The inner shell defines a chamber therein having a floor and opening to a inner shell top, the floor sloping from a higher end to a lower end. The box portion defines a drain hole passing therethrough adjacent to the lower end. The inner shell and the outer shell define a cavity therebetween adjacent to the floor. The cavity, into which a tray fits, opens to a hole defined by the outer shell. The outer shell includes a bottom from which four feet that are molded into the outer shell extend so as to form an air gap between the bottom and any surface upon which the cooler is placed. A door is configured to cover the hole. The outer shell defines a first recess about the hole so that neither the door nor the attachment member extends beyond an outer surface of the outer shell when the door is in a closed position. A lid portion is configured to fit against the inner shell top.

20 Claims, 5 Drawing Sheets

U.S. PATENT DOCUMENTS

| | | | | |
|---|---|---|---|---|
| 6,446,382 | B1 | 9/2002 | Cloutier et al. | |
| 6,463,756 | B1 * | 10/2002 | Lewis | 62/457.7 |
| 6,615,607 | B1 * | 9/2003 | Lee | 62/440 |
| 6,651,456 | B1 * | 11/2003 | White et al. | 62/457.7 |
| 6,658,903 | B1 * | 12/2003 | McShane et al. | 70/63 |
| 6,673,594 | B1 * | 1/2004 | Owen et al. | 435/284.1 |
| 6,736,128 | B1 * | 5/2004 | Nordeen | 126/25 R |
| 6,763,959 | B2 * | 7/2004 | Tedder | 211/188 |
| D503,413 | S * | 3/2005 | Diaz | D15/83 |
| 6,964,179 | B2 * | 11/2005 | Yoshida | 62/457.9 |
| 7,040,115 | B1 * | 5/2006 | Lopez et al. | 62/457.2 |
| 7,051,550 | B2 * | 5/2006 | Roth et al. | 62/457.2 |
| 7,178,673 | B1 * | 2/2007 | Miller | 206/545 |
| 7,188,489 | B2 * | 3/2007 | Martello | 62/420 |
| 7,188,491 | B2 * | 3/2007 | Donald et al. | 62/457.7 |
| 7,284,393 | B1 * | 10/2007 | Macmillan | 62/457.7 |
| 7,309,106 | B2 * | 12/2007 | Stallman | 297/310 |
| 7,340,917 | B1 * | 3/2008 | Coleman | 62/457.2 |
| 7,603,875 | B2 * | 10/2009 | Carr | 62/457.7 |
| 2002/0043076 | A1 * | 4/2002 | Hodosh et al. | 62/457.4 |
| 2004/0093892 | A1 * | 5/2004 | Abfalter | 62/457.7 |
| 2004/0200232 | A1 * | 10/2004 | Gano et al. | 62/457.2 |
| 2006/0288730 | A1 | 12/2006 | Shill | |
| 2009/0188214 | A1 * | 7/2009 | Vohnout-Marle et al. | 53/492 |

FOREIGN PATENT DOCUMENTS

| | | |
|---|---|---|
| WO | 97/17582 | 5/1997 |

* cited by examiner

COOLER ADAPTED FOR USE IN MARINE ENVIRONMENT

CROSS-REFERENCE TO RELATED APPLICATION(S)

This application claims the benefit of U.S. Provisional Patent Application Ser. No. 61/074,014, filed Jun. 19, 2008, the entirety of which is hereby incorporated herein by reference.

BACKGROUND OF THE INVENTION

1. Field of the Invention

The present invention relates to food storage equipment and, more specifically, to a cooler adapted for use in a marine environment.

2. Description of the Prior Art

Coolers have long been used to maintain the temperature of objects inside of the coolers. Typical coolers include box and a lid made of a plastic shell filled with either air or an insulator. A user often puts ice into the cooler to keep the temperature inside cool.

Many conventional coolers do not work well in the marine environment. This is for several reasons. One problem with conventional coolers is that they are unitary devices in which everything is placed into the cooler. Placing certain things, such as bait and sandwiches, into a cooler may not work well. Sandwiches can become wet from melting ice and bait can contaminate the food contents of the cooler.

In the marine environment, a cooler is often packed tightly with respect to other objects. This may be necessary because of space limitations on boats. Most coolers have many things (such as locking mechanisms, drains spouts and handles) protruding from the outer surfaces of the coolers. These things can catch on the other objects, thereby making packing difficult. Also, when coolers are slid against other objects, the things that protrude from the coolers can be damaged by the other objects or they can damage the other objects.

The lids of conventional coolers are often sealed to the boxes by a single downwardly-extending seal. In the marine environment, if water is sprayed at the cooler (for example, as a result of a fresh water hosing down of a boat), the water will can migrate downwardly along the seal into the cooler.

Also, many coolers have flat bottoms. When the cooler is set down on a hot surface, such as the asphalt surface of a pier on a sunny day, a substantial amount of heat can be transferred to the cooler from the hot surface. This can greatly decrease the cooling capacity of the cooler.

Sometimes a user needs to lift the cooler, such as while lifting the cooler onto a boat. At other times, a pair of users will need to carry the cooler for a long distance, such as along the length of a pier. Most coolers are designed to facilitate either lifting of the cooler or carrying of the cooler, but not both.

Many coolers use a chord or a slideable arm to prevent the lid from overextending when being opened. Such chords and arm often bread with use and they can obstruct side access to the cooler.

Some coolers define circular drink holders in their lids. However, such drink holders do not provide a very good place to put such things a bait and objects larger than drinks. However, those engaged in fishing often need to place such things in holders so they do not roll away with the pitching and rolling of the boat.

Therefore, there is a need for a cooler especially adapted for the marine environment.

SUMMARY OF THE INVENTION

The disadvantages of the prior art are overcome by the present invention which, in one aspect, is a cooler that includes a box portion having a rigid outer shell and a rigid inner shell, an insulative material disposed between the outer shell and the inner shell. The inner shell defines a chamber therein having a floor and opening to a inner shell top, the floor sloping from a higher end to a lower end. The box portion defines a drain hole passing therethrough adjacent to the lower end. The inner shell and the outer shell define a cavity therebetween adjacent to the floor. The inner shell forms a first upright wall of the cavity, a second upright wall of the cavity and a horizontal wall of the cavity. The cavity opens to a hole defined by the outer shell. The outer shell includes a bottom from which four feet that are molded into the outer shell extend so as to form an air gap between the bottom and any surface upon which the cooler is placed. A removable tray fits into the cavity. A door is configured to cover selectively the hole defined by the outer shell. The door is hingedly attached to the outer shell with an attachment member. The outer shell defines a first recess about the hole so that neither the door nor the attachment member extends beyond an outer surface of the outer shell when the door is in a closed position. A lid portion is configured to fit against the inner shell top.

A hinge includes a first hinge part molded into the outer shell adjacent the inner shell top and second hinge part molded into the lid portion. The first hinge part is coupled to the second hinge part to allow hinged movement therebetween. A seal is configured to seal the lid portion to the box portion. The seal includes a flat upper peripheral edge defined by a top of the box portion; a flat lower peripheral edge defined by a bottom of the lid portion and configured to engage the flat upper peripheral edge defined by the box portion; a protrusion extending upwardly substantially along the entire upper peripheral edge of the box portion; and an indentation extending upwardly into substantially the entire lower peripheral edge of the lid portion and configured to engage the protrusion.

A locking device is configured to hold the lid portion against the box portion. The outer shell and the lid portion define a second recess into which the locking device fits so that the locking device does not extend beyond the outer shell when the locking device is in a closed state.

The outer shell has two opposite sides, wherein each opposite side defines a rigid gripping surface recess to facilitate lifting of the cooler. An elongated handle also extends from each opposite side to facilitate carrying of the cooler by two people. A drain spout extends from the drain hole to facilitate draining of liquids from the cooler. The outer shell defines a recessed area adjacent to the drain spout and the drain spout has a length so as not to extend beyond the recessed area.

In another aspect, the invention is a cooler that includes a box portion having a rigid outer shell and a rigid inner shell, an insulative material disposed between the outer shell and the inner shell, the inner shell defining a chamber therein having a floor and opening to a inner shell top, the floor sloping from a higher end to a lower end, the box portion defining a drain hole passing therethrough adjacent to the lower end, the inner shell and the outer shell defining a cavity therebetween adjacent to the floor, the inner shell forming a first upright wall of the cavity, a second upright wall of the cavity, and a horizontal wall of the cavity, the cavity opening to a hole defined by the outer shell, the first upright wall of the cavity, the second upright wall of the cavity, and the horizontal wall of the cavity each made of a material that is both impervious to water and substantially non-insulating so that objects placed inside of the cavity are isolated from fluids in the chamber while being maintained at a temperature corresponding a temperature inside the chamber. A tray fits into the cavity configured to hold objects therein. A door is configured to selectively cover the hole defined by the outer shell. The door is hingedly attached to the outer shell with an attachment member. A lid portion is configured to fit against the inner shell top.

A hinge includes a first hinge part molded into the outer shell adjacent the inner shell top and second hinge part molded into the lid portion. The first hinge part is coupled to the second hinge part to allow hinged movement therebetween. A seal is configured to seal the lid portion to the box portion. The seal includes: a flat upper peripheral edge defined by a top of the box portion; a flat lower peripheral edge defined by a bottom of the lid portion and configured to engage the flat upper peripheral edge defined by the box portion; a protrusion extending upwardly substantially along the entire upper peripheral edge of the box portion; and an indentation extending upwardly into substantially the entire lower peripheral edge of the lid portion and configured to engage the protrusion.

In yet another aspect, the invention is a cooler that includes a box portion having a rigid outer shell and a rigid inner shell, an insulative material disposed between the outer shell and the inner shell, the inner shell defining a chamber therein having a floor and opening to a inner shell top, the floor sloping from a higher end to a lower end, the box portion defining a drain hole passing therethrough adjacent to the lower end, the inner shell and the outer shell defining a cavity therebetween adjacent to the floor, the inner shell forming a first upright wall of the cavity, a second upright wall of the cavity and a horizontal wall of the cavity, the cavity opening to a hole defined by the outer shell. A door is configured to cover selectively the hole defined by the outer shell, the door hingedly attached to the outer shell with an attachment member. The outer shell defines a first recess about the hole so that neither the door nor the attachment member extends beyond an outer surface of the outer shell when the door is in a closed position. A lid portion is configured to fit against the inner shell to.

A hinge includes a first hinge part molded into the outer shell adjacent the inner shell top and second hinge part molded into the lid portion. The first hinge part is coupled to the second hinge part to allow hinged movement therebetween. A seal is configured to seal the lid portion to the box portion. A locking device is configured to hold the lid portion against the box portion. The outer shell and the lid portion define a second recess into which the locking device fits so that the locking device does not extend beyond the outer shell when the locking device is in a closed state. A drain spout extends from the drain hole to facilitate draining of liquids from the cooler. The outer shell defines a recessed area adjacent to the drain spout and the drain spout having a length so as not to extend beyond the recessed area.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

DETAILED DESCRIPTION OF THE INVENTION

Figure 1:
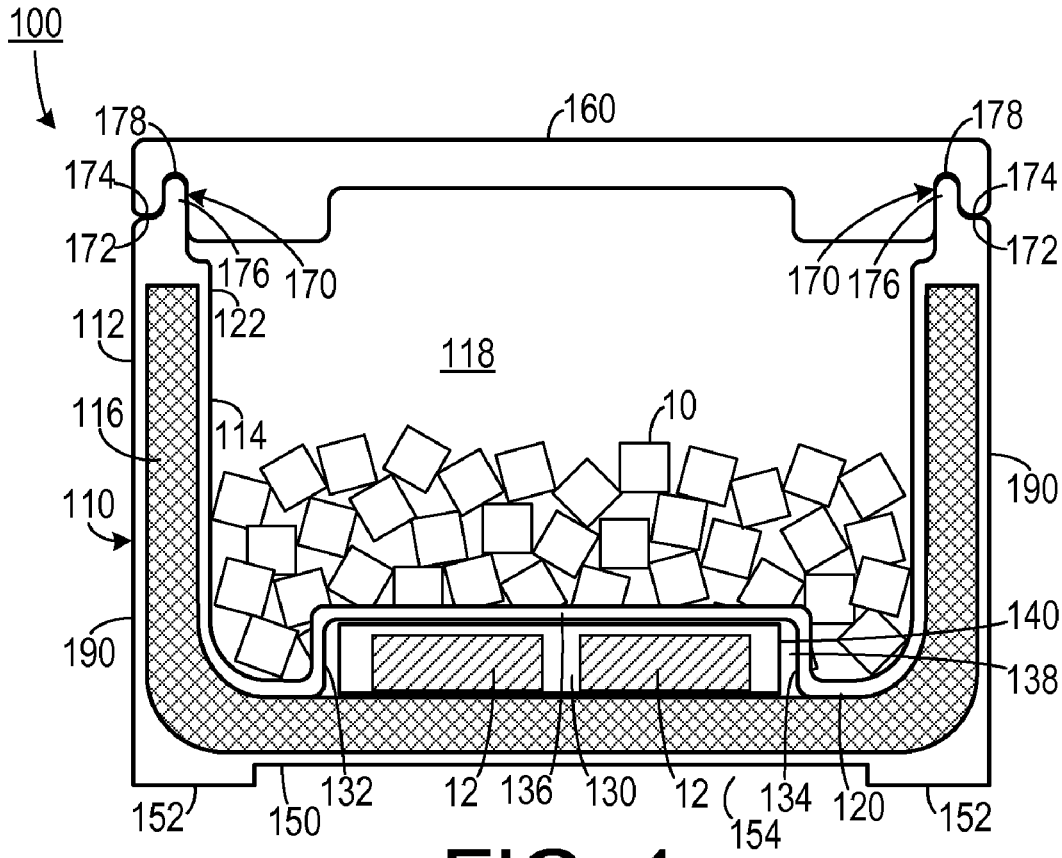
FIG. 1 is a front view schematic diagram of one representative embodiment of the invention.
Figure 2:
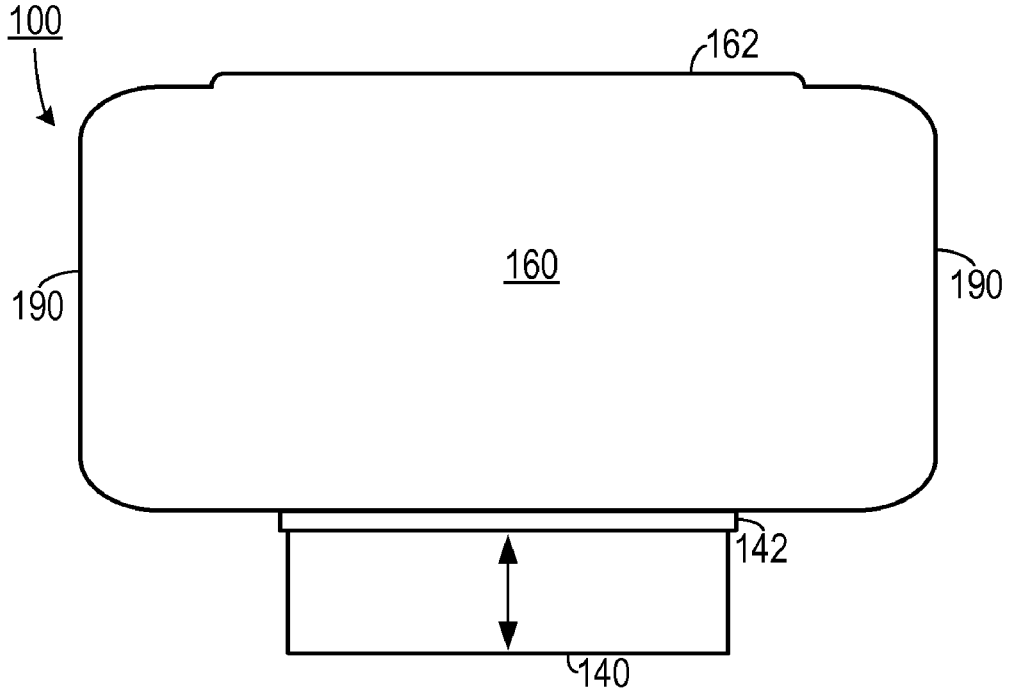
FIG. 2 is a top plan view of one representative embodiment of the invention.
Figure 3:
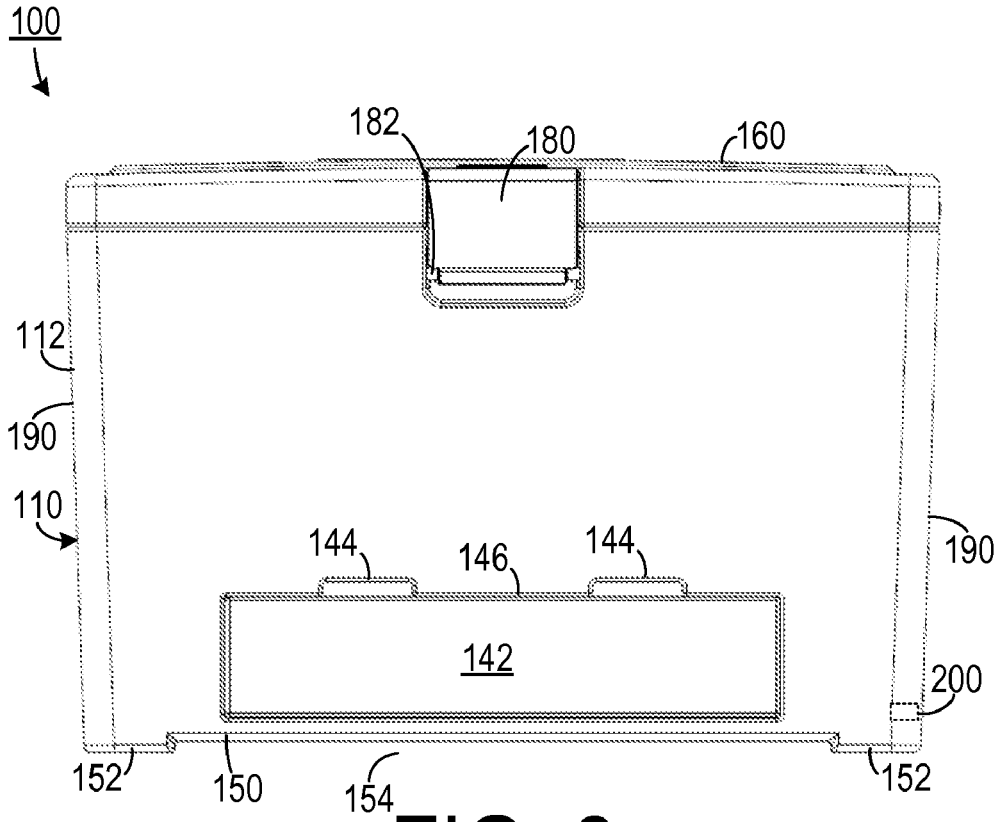
FIG. 3 is a front elevational view of a second representative embodiment of the invention.
Figure 4:
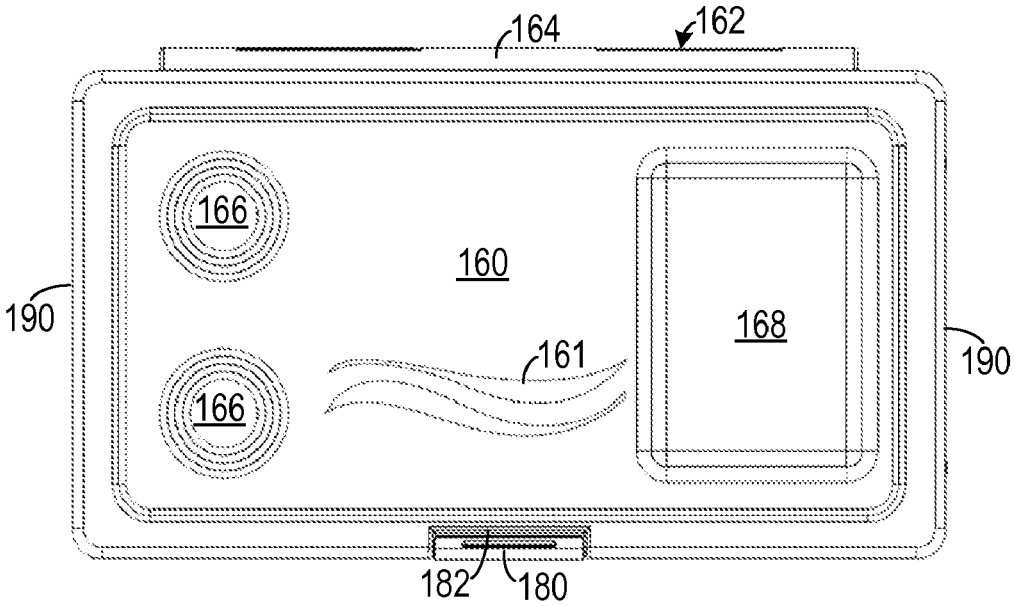
FIG. 4 is a top plan view of the embodiment shown in FIG. 3.
Figure 5:
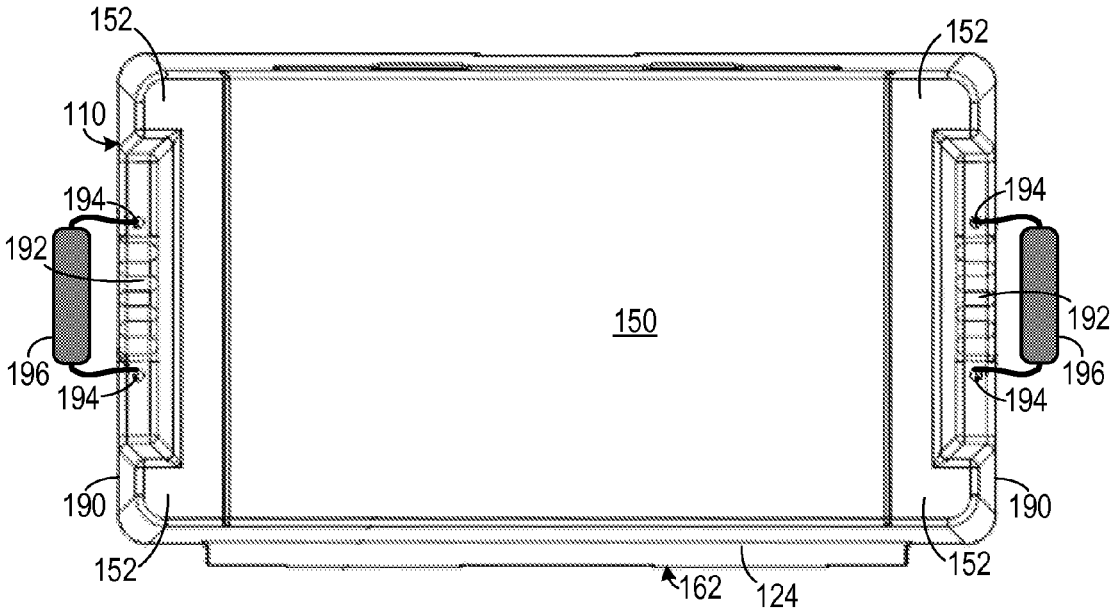
FIG. 5 is a bottom plan view of the embodiment shown in FIG. 3.
Figure 6:
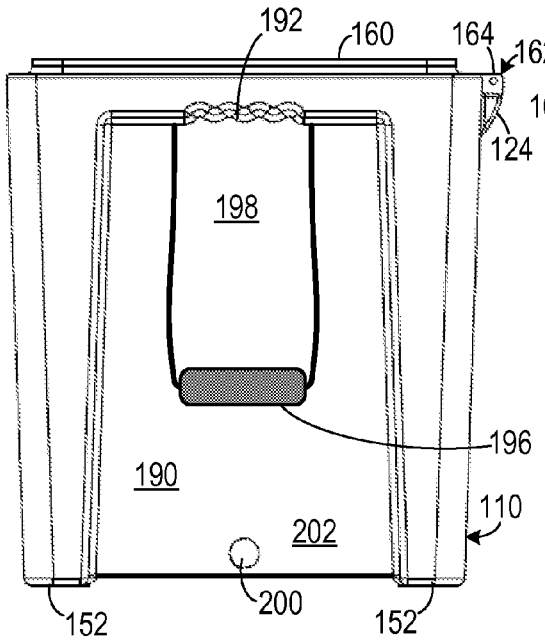
FIG. 6 is a right elevational view of the embodiment shown in FIG. 3.
Figure 7:
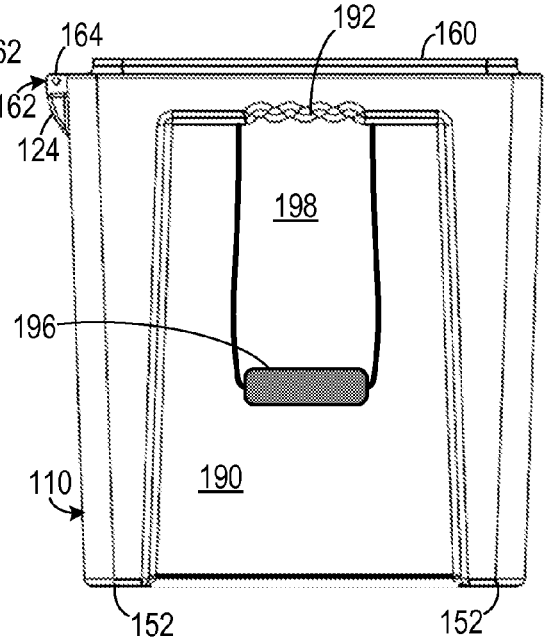
FIG. 7 is a left elevational view of the embodiment shown in FIG. 3.
Figure 8:
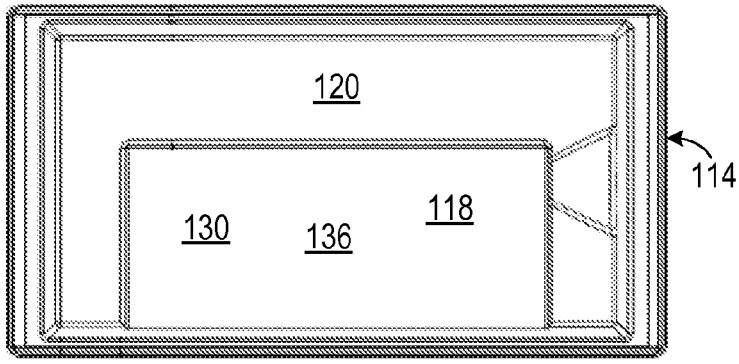
FIG. 8 is a top plan view of a representative embodiment of an inner shell of a type that may be employed in the embodiment shown in FIG. 3.
Figure 9:
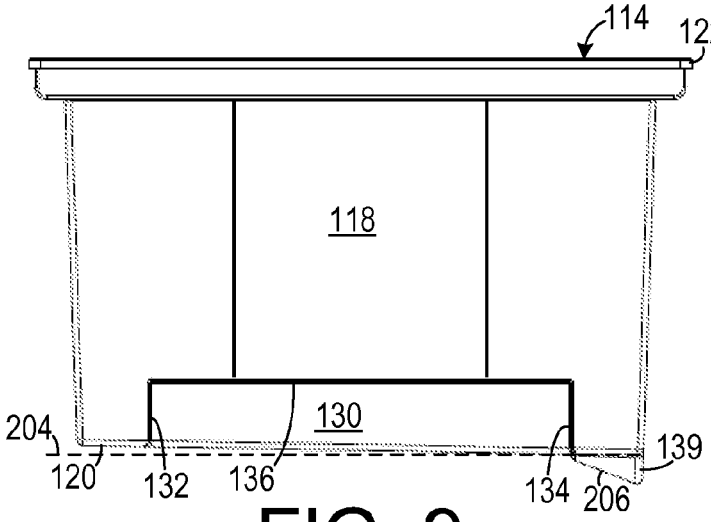
FIG. 9 is a front elevational view of the inner shell shown in FIG. 8.
Figure 11:
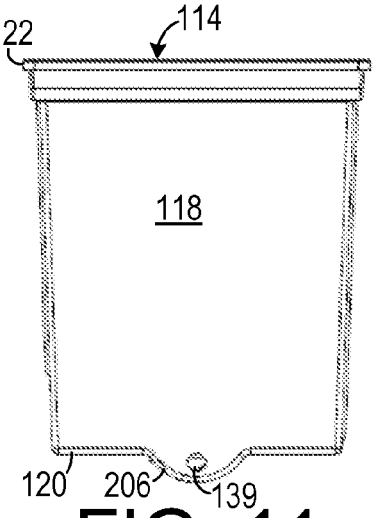
FIG. 11 is a right elevational view of the inner shell shown in FIG. 8.
Figure 10:
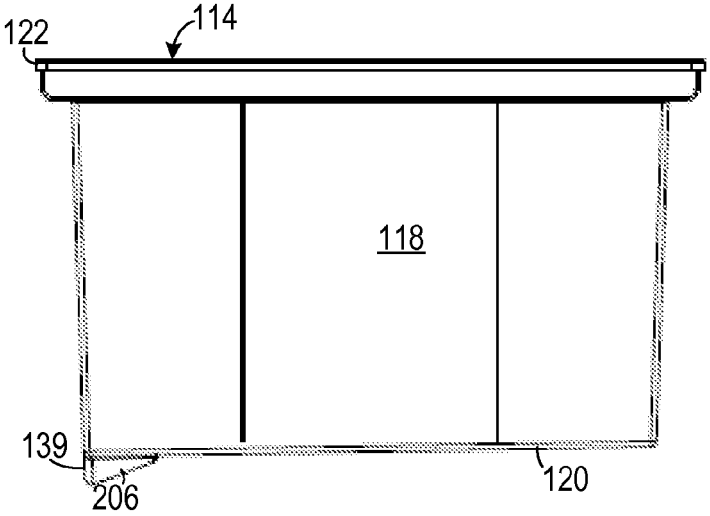
FIG. 10 is a rear elevational view of the inner shell shown in FIG. 8.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

As shown in FIGS. 1 through 7, one embodiment of a cooler 100 includes a box portion 110 and a lid portion 160 that fits against the box portion 110 so as to cover a chamber 118 inside the box portion 110. The lid portion 160 is held to the box portion 110 via a hinge 162. The box portion 110 includes an outer shell 112 and an inner shell 114, both of which are made of a rigid material, such as a rigid plastic or metal. The outer shell 112 and the inner shell 114 are separated by an insulative material 116, such as a foam or other insulating material (which, in one embodiment, could include air).

The inner shell 114 and the outer shell 112 can be made using well known methods used in cooler manufacturing, such as injection molding and vacuum forming. Insulative foam may be injected into the space formed by the inner shell 114 and the outer shell 112.

The inner shell 114 and the outer shell 112 define a cavity 130 therebetween and the cavity 130 opens to a hole 138 defined by the outer shell 114. The cavity is separated from the chamber 118 by a first vertical wall 132, a second vertical wall 134 and a horizontal wall 136 defined by the inner shell 114. One or more trays 140, such as a rectangular plastic tray, fit through the hole 138 and into the cavity 130. If the tray 140 is fully removable, then it can be washed independently from the cooler 100. The inner shell 114 is made of a material that that is impervious to liquids and that readily transmits heat, so that the cavity 130 is maintained a temperature that is close to the temperature of the chamber 118 and so that the contents 12 of the cavity 130 are kept dry. For example, if ice 10 is placed in the chamber 118, then the ice will keep the contents 12 cool and the contents 12 (which could include, for example, a sandwich) will also remain dry. A door 142 is attached to the outer shell 112 with one or more hinges 144 and is used to cover the hole 138 when the tray 140 is in the cavity 130. The outer shell 112 can define a recess 146 into which the hinges 144 and the door 142 fit when the door is closed. This recess 146 prevents the door 142 from protruding from the outer shell 112 and interfering with the horizontal sliding of the cooler 100 past vertical surfaces of other objects when the cooler 100 is being packed closely with such objects.

When closed, the lid portion 160 is sealed to the body portion 110 with a seal 170, which runs substantially along the entire upper peripheral edge 172 of the box portion 110. The seal 170 includes a protrusion 176 extending upwardly from upper peripheral edge 172 near the top 122 of the box portion 110. An indentation 178 extends upwardly into substantially the entire lower peripheral edge 174 of the lid portion and is configured to mate and engage the protrusion 176. In this way, if water is sprayed at the cooler 100, it will not be able to violate the seal 170 unless it passes through at least three mated surfaces and travels upwardly past the protrusion 176. This reduces the likelihood that water sprayed at the cooler 100 will leak into the chamber 118.

The lid portion 160 can define circular recesses 166 to act as drink holders. It can also define recesses 168 of other shapes (e.g., rectangles) to hold things like sandwiches and bait, which can make it particularly useful in a marine environment. Typically recess 168 would be of an area that is larger than the area of the circular recesses 166.

The outer shell 112 includes a bottom surface 150 from which four feet 152 are molded so as to extend downwardly from the bottom surface 150. These feet 152 form an air gap 154 between most of the bottom surface 150 and any surface upon which the cooler 100 is placed. For example, if the cooler 100 is placed on an asphalt surface on a hot sunny day, this air gap 154 can greatly reduce the rate at which heat is transferred from the asphalt surface to the cooler 100, thereby greatly extending the cooling capacity of the cooler.

A locking mechanism 180 may be used to secure the lid portion 160 to the box portion 110. The lid portion 160 and the box portion 110 define a recess 182 into which the locking mechanism 180 fits so as not to extend beyond the outer surface of the outer shell 112. This prevents the locking mechanism 180 from being damaged when the cooler 100 is slid laterally against other vertical surfaces and it prevents the locking mechanism 180 from scratching such vertical surfaces.

The cooler 100 includes two opposite sides 190 that each defines a recess 198. Each recess 198 has molded therein a rigid gripping surface 192 to facilitate lifting of the cooler 100. Adjacent to each gripping surface 192 is a pair of attachment points 194 to which is attached an elongated handle 196. The elongated handles 196 facilitate carrying of the cooler 100 by two individuals.

One of the sides 190 defines a recessed area from which a drain spout 200 extends. The drain spout does not extend beyond the outer surface of the outer shell 112. This feature prevents damage to the drain spout 200 when the cooler 100 is slid against vertical surfaces of other objects.

Figure 12A:
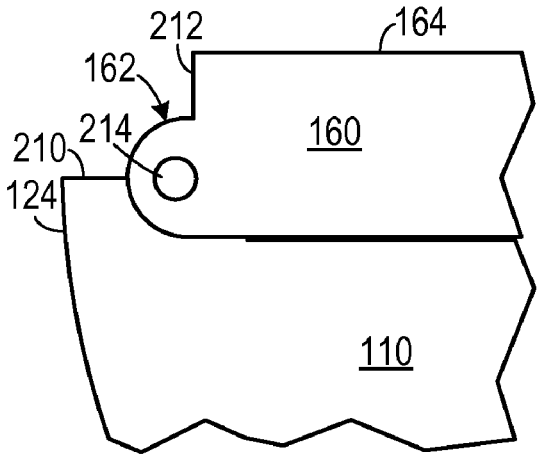
FIGS. 12A-12B are schematic diagram details of a lid hinge mechanism.
Figure 12B:
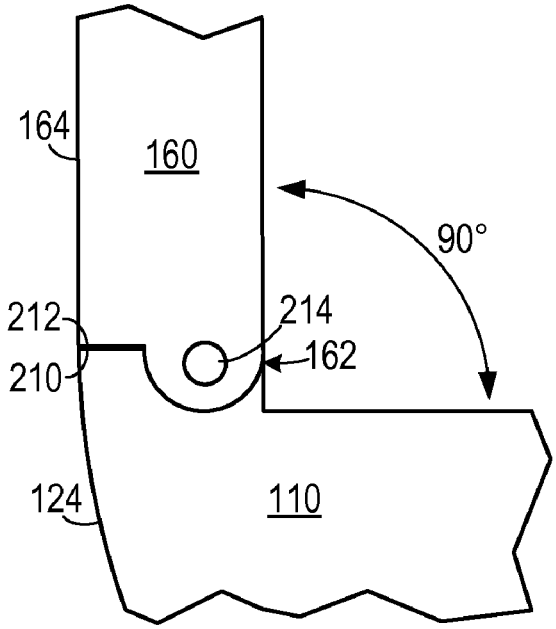

As mentioned above, the lid portion 160 is hingedly attached to the box portion 110 with a hinge 162. The hinge includes a first hinge part 124 molded into the outer shell 112 and second hinge part 164 molded into the lid portion 160. As shown in FIGS. 12A-B, the first hinge part 124 is coupled to the second hinge part 164 with a common hinge rod 214 to allow hinged movement therebetween. The first hinge part 124 defines a first stopping surface running laterally along the length of the first hinge part 124. The second hinge part 164 defines a second stopping surface 212 running laterally along the length of the second hinge part 164. When the lid portion 160 is fully opened with respect to the box portion 110, the first stopping surface 210 and the second stopping surface 212 engage each other, thereby preventing the lid portion 160 from extending beyond a preselected angle (such as 90°) from the box portion 110.

One embodiment of the inner shell 114 is shown in greater detail in FIGS. 8-11. One end of the inner shell 114 defines a drain hole 139 that is in fluid communication with the drain spout 200 (shown in FIGS. 3 and 6). The inner shell 114 includes a floor surface 120 that slopes at an angle (for example, an angle as low as 1° angle) relative to horizontal 204. The slope of the floor surface 120 is in the direction of the drain hole 139 to facilitate the complete draining of liquids (e.g., melted ice) from the chamber without requiring the user to tip the cooler 100. A sump 206 may be defined from the floor surface 120 adjacent the drain hole 139 to facilitate more complete draining of the cooler 100.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A cooler, comprising:

a. a box portion having a rigid outer shell and a rigid inner shell, an insulative material disposed between the outer shell and the inner shell, the inner shell defining a chamber therein having a floor and opening to a inner shell top, the floor sloping from a higher end to a lower end, the box portion defining a drain hole passing therethrough adjacent to the lower end, the inner shell and the outer shell defining a cavity therebetween adjacent to the floor, the inner shell forming a first upright wall of the cavity, a second upright wall of the cavity and a horizontal wall of the cavity, the cavity opening to a hole defined by the outer shell, the outer shell including a bottom from which four feet molded into the outer shell extend so as to form an air gap between the bottom and any surface upon which the cooler is placed;

b. a removable tray that fits into the cavity;

c. a door configured to selectively cover the hole defined by the outer shell, the door hingedly attached to the outer shell with an attachment member;

d. the outer shell defining a first recess about the hole so that neither the door nor the attachment member extends beyond an outer surface of the outer shell when the door is in a closed position;

e. a lid portion configured to fit against the inner shell top;

f. a hinge including a first hinge part molded into the outer shell adjacent the inner shell top and second hinge part molded into the lid portion, the first hinge part coupled to the second hinge part to allow hinged movement therebetween;

g. a seal configured to seal the lid portion to the box portion, the seal including:
   i. a flat upper peripheral edge defined by a top of the box portion;
   ii. a flat lower peripheral edge defined by a bottom of the lid portion and configured to matingly engage the flat upper peripheral edge defined by the box portion;
   iii. a protrusion extending upwardly substantially along the entire upper peripheral edge of the box portion; and
   iv. an indentation extending upwardly into substantially the entire lower peripheral edge of the lid portion and configured to matingly engage the protrusion;
h. a locking device configured to hold the lid portion against the box portion, the outer shell and the lid portion defining a second recess into which the locking device fits so that the locking device does not extend beyond the outer shell when the locking device is in a closed state;
i. the outer shell having two opposite sides, wherein each opposite side defines a rigid gripping surface recess to facilitate lifting of the cooler, an elongated handle also extending from each opposite side to facilitate carrying of the cooler by two people; and
j. a drain spout extending from the drain hole to facilitate draining of liquids from the cooler, the outer shell defining a recessed area adjacent to the drain spout and the drain spout having a length so as not to extend beyond the recessed area.

2. The cooler of claim 1, wherein the first upright wall of the cavity, the second upright wall of the cavity, and the horizontal wall of the cavity are each made of a material that is both impervious to water and substantially non-insulating so that objects placed inside of the cavity are isolated from fluids in the chamber while being maintained at a temperature corresponding a temperature inside the chamber.

3. The cooler of claim 1, wherein the hinge includes a stopping mechanism that prevents the lid from extending more that 90° from the top of the box portion when the lid portion is fully opened.

4. The cooler of claim 1, wherein the lid portion has an outer surface that defines at least two recess, including:
a. a circular recess configured to hold drinks therein; and
b. a rectangular recess configured to hold items therein.

5. A cooler, comprising:
a. a box portion having a rigid outer shell and a rigid inner shell, an insulative material disposed between the outer shell and the inner shell, the inner shell defining a chamber therein having a floor and opening to a inner shell top, the floor sloping from a higher end to a lower end, the box portion defining a drain hole passing therethrough adjacent to the lower end, the inner shell and the outer shell defining a cavity therebetween adjacent to the floor, the inner shell forming a first upright wall of the cavity, a second upright wall of the cavity, and a horizontal wall of the cavity, the cavity opening to a hole defined by the outer shell, the first upright wall of the cavity, the second upright wall of the cavity, and the horizontal wall of the cavity each made of a material that is both impervious to water and substantially non-insulating so that objects placed inside of the cavity are isolated from fluids in the chamber while being maintained at a temperature corresponding a temperature inside the chamber;
b. a tray that fits into the cavity configured to hold objects therein;
c. a door configured to selectively cover the hole defined by the outer shell, the door hingedly attached to the outer shell with an attachment member;
d. a lid portion configured to fit against the inner shell top;
e. a hinge including a first hinge part molded into the outer shell adjacent the inner shell top and second hinge part molded into the lid portion, the first hinge part coupled to the second hinge part to allow hinged movement therebetween; and
f. a seal configured to seal the lid portion to the box portion, the seal including:
   i. a flat upper peripheral edge defined by a top of the box portion;
   ii. a flat lower peripheral edge defined by a bottom of the lid portion and configured to matingly engage the flat upper peripheral edge defined by the box portion;
   iii. a protrusion extending upwardly substantially along the entire upper peripheral edge of the box portion; and
   iv. an indentation extending upwardly into substantially the entire lower peripheral edge of the lid portion and configured to matingly engage the protrusion.

6. The cooler of claim 5, wherein the tray comprises removable a removable tray.

7. The cooler of claim 5, wherein the outer shell defines a first recess about the hole so that neither the door nor the attachment member extends beyond an outer surface of the outer shell when the door is in a closed position.

8. The cooler of claim 5, further comprising a locking device configured to hold the lid portion against the box portion, the outer shell and the lid portion defining a second recess into which the locking device fits so that the locking device does not extend beyond the outer shell when the locking device is in a closed state.

9. The cooler of claim 5, wherein the outer shell having two opposite sides, wherein each opposite side defines a rigid gripping surface recess to facilitate lifting of the cooler, an elongated handle also extending from each opposite side to facilitate carrying of the cooler by two people.

10. The cooler of claim 5, further comprising a drain spout extending from the drain hole to facilitate draining of liquids from the cooler, the outer shell defining a recessed area adjacent to the drain spout and the drain spout having a length so as not to extend beyond the recessed area.

11. The cooler of claim 5, wherein the outer shell includes a bottom from which four feet molded into the outer shell extend so as to form an air gap between the bottom and any surface upon which the cooler is placed.

12. The cooler of claim 5, wherein the hinge includes a stopping mechanism that prevents the lid from extending more that 90° from the top of the box portion when the lid portion is fully opened.

13. The cooler of claim 5, wherein the lid portion has an outer surface that defines at least two recess, including:
a. a circular recess configured to hold drinks therein; and
b. a rectangular recess configured to hold items therein.

14. A cooler, comprising:
a. a box portion having a rigid outer shell and a rigid inner shell, an insulative material disposed between the outer shell and the inner shell, the inner shell defining a chamber therein having a floor and opening to a inner shell top, the floor sloping from a higher end to a lower end, the box portion defining a drain hole passing therethrough adjacent to the lower end, the inner shell and the outer shell defining a cavity therebetween adjacent to the floor, the inner shell forming a first upright wall of the cavity, a second upright wall of the cavity and a horizontal wall of the cavity, the cavity opening to a hole defined by the outer shell;

b. a door configured to selectively cover the hole defined by the outer shell, the door hingedly attached to the outer shell with an attachment member;

c. the outer shell defining a first recess about the hole so that neither the door nor the attachment member extends beyond an outer surface of the outer shell when the door is in a closed position;

d. a lid portion configured to fit against the inner shell top;

e. a hinge including a first hinge part molded into the outer shell adjacent the inner shell top and second hinge part molded into the lid portion, the first hinge part coupled to the second hinge part to allow hinged movement therebetween;

f. a seal configured to seal the lid portion to the box portion;

g. a locking device configured to hold the lid portion against the box portion, the outer shell and the lid portion defining a second recess into which the locking device fits so that the locking device does not extend beyond the outer shell when the locking device is in a closed state; and h. a drain spout extending from the drain hole to facilitate draining of liquids from the cooler, the outer shell defining a recessed area adjacent to the drain spout and the drain spout having a length so as not to extend beyond the recessed area.

15. The cooler of claim 14, wherein the hinge includes a stopping mechanism that prevents the lid from extending more that 90° from the top of the box portion when the lid portion is fully opened.

16. The cooler of claim 14, wherein the lid portion has an outer surface that defines at least two recess, including:

a. a circular recess configured to hold drinks therein; and b. a rectangular recess configured to hold items therein.

17. The cooler of claim 14, wherein the outer shell includes a bottom from which four feet molded into the outer shell extend so as to form an air gap between the bottom and any surface upon which the cooler is placed.

18. The cooler of claim 14, further comprising a removable tray that fits into the cavity.

19. The cooler of claim 14, wherein the outer shell has two opposite sides, wherein each opposite side defines a rigid gripping surface recess to facilitate lifting of the cooler, an elongated handle also extending from each opposite side to facilitate carrying of the cooler by two people.

20. The cooler of claim 14, wherein the seal comprises:

a. a flat upper peripheral edge defined by a top of the box portion;

b. a flat lower peripheral edge defined by a bottom of the lid portion and configured to matingly engage the flat upper peripheral edge defined by the box portion;

c. a protrusion extending upwardly substantially along the entire upper peripheral edge of the box portion; and d. an indentation extending upwardly into substantially the entire lower peripheral edge of the lid portion and configured to matingly engage the protrusion.

* * * * *